US007663555B2

(12) United States Patent
Caimi et al.

(10) Patent No.: US 7,663,555 B2
(45) Date of Patent: Feb. 16, 2010

(54) METHOD AND APPARATUS FOR ADAPTIVELY CONTROLLING ANTENNA PARAMETERS TO ENHANCE EFFICIENCY AND MAINTAIN ANTENNA SIZE COMPACTNESS

(75) Inventors: Frank M. Caimi, Vero Beach, FL (US); Gregory A. O'Neill, Jr., Rockledge, FL (US); Young-Min Jo, Viera, FL (US)

(73) Assignee: Sky Cross Inc., Melbourne, FL (US)

( * ) Notice: Subject to any disclaimer, the term of this patent is extended or adjusted under 35 U.S.C. 154(b) by 164 days.

(21) Appl. No.: 11/252,248

(22) Filed: Oct. 17, 2005

(65) Prior Publication Data

US 2006/0132360 A1 Jun. 22, 2006

Related U.S. Application Data

(60) Provisional application No. 60/619,231, filed on Oct. 15, 2004.

(51) Int. Cl.
*H01Q 1/24* (2006.01)
*H01Q 1/50* (2006.01)

(52) U.S. Cl. ..... 343/702; 343/861; 455/575.7

(58) Field of Classification Search ..... 343/745, 343/876, 702, 850, 861; 455/123, 575.7
See application file for complete search history.

(56) References Cited

U.S. PATENT DOCUMENTS 4,165,493 A * 8/1979 Harrington ..... 330/207 P
4,564,843 A * 1/1986 Cooper ..... 343/745
5,155,493 A 10/1992 Thursby et al.
5,361,403 A 11/1994 Dent
5,423,074 A 6/1995 Dent
5,771,444 A 6/1998 Dent et al.
5,778,308 A 7/1998 Sroka et al.
5,832,374 A 11/1998 Birth et al.
5,842,140 A 11/1998 Dent et al.
5,874,919 A 2/1999 Rawnick et al.
5,926,147 A 7/1999 Sehm et al.
5,991,608 A 11/1999 Leyten
6,028,564 A 2/2000 Duan et al.

(Continued)

FOREIGN PATENT DOCUMENTS

EP 1271691 A2 1/2003

OTHER PUBLICATIONS

Pan, Helen K. et al., RF MEMS Integration in Reconfigurable Bent Monopole Antenna Design, 2006 National Radio Science Meeting, Abstract, 1 pg.

(Continued)

*Primary Examiner*—Michael C Wimer
(74) *Attorney, Agent, or Firm*—John L. DeAngelis; Beusse Wolter Sanks Mora & Maire, P.A.

(57) ABSTRACT

An antenna for a communications device having configurable elements controlled to modify an antenna impedance and/or an antenna resonant frequency to improve performance of the communications device. The antenna impedance is controlled to substantially match to an output impedance of a power amplifier that supplies the antenna with a signal for transmission. The antenna resonant frequency is controlled to overcome the effects of various operating conditions that can detune the antenna or in response to an operable frequency band.

11 Claims, 6 Drawing Sheets

U.S. PATENT DOCUMENTS

| | | | | |
|---|---|---|---|---|
| 6,097,347 | A | 8/2000 | Duan et al. | |
| 6,178,313 | B1 | 1/2001 | Mages et al. | |
| 6,535,175 | B2 | 3/2003 | Brady et al. | |
| 6,650,295 | B2 | 11/2003 | Ollikainen et al. | |
| 6,693,594 | B2 | 2/2004 | Pankinaho et al. | |
| 6,759,988 | B2 | 7/2004 | Purr et al. | |
| 6,784,844 | B1 | 8/2004 | Boakes et al. | |
| 6,845,126 | B2 | 1/2005 | Dent et al. | |
| 6,889,034 | B1 | 5/2005 | Dent | |
| 6,895,225 | B1 | 5/2005 | Talvitie et al. | |
| 6,903,687 | B1 | 6/2005 | Fink et al. | |
| 6,904,296 | B2 | 6/2005 | Geeraert et al. | |
| 6,952,144 | B2 * | 10/2005 | Javor | 333/32 |
| 6,961,368 | B2 | 11/2005 | Dent et al. | |
| 7,002,519 | B2 | 2/2006 | Wang et al. | |
| 2002/0044100 | A1 * | 4/2002 | Jagielski et al. | 343/850 |
| 2003/0076168 | A1 * | 4/2003 | Forrester | 330/129 |
| 2004/0145523 | A1 | 7/2004 | Shamblin et al. | |
| 2004/0185916 | A1 * | 9/2004 | Chang et al. | 455/572 |
| 2004/0242170 | A1 * | 12/2004 | Gilbert | 455/127.1 |
| 2005/0093624 | A1 * | 5/2005 | Forrester et al. | 330/129 |
| 2005/0186931 | A1 | 8/2005 | Laiho et al. | |
| 2005/0237251 | A1 | 10/2005 | Boyle et al. | |
| 2005/0264455 | A1 | 12/2005 | Talvitie et al. | |
| 2005/0270105 | A1 | 12/2005 | Van Bezooijen et al. | |
| 2006/0017635 | A1 | 1/2006 | Zheng | |
| 2006/0066490 | A1 | 3/2006 | Ku et al. | |
| 2006/0099921 | A1 | 5/2006 | Hong et al. | |

OTHER PUBLICATIONS

Han, Yongping et al., Towards Multi-Service Wireless Universal Receiver, 2006 National Radio Science Meeting, Abstract, 1 pg.

Zhang, Chunna et al., Compact Novel Reconfigurable Antennas for Multi-Band Operation, 2006 National Radio Science Meeting, Abstract, 1 pg.

Vainikainen, Pertti, et al., Resonator-Based Analysis of the Conbination of Mobile Handset Antenna and Chassis, IEEE Transactions on Antennas and Propagation vol. 50, No. 10, pp. 1433-1444, Oct. 2002.

Raisanen, Antti V. et al., Hut Radio Laboratory Research and Education 2002, Abstract, 1 pg.

Vendelin, George D. et al., Microwave Circuit Design Using Linear and Nonlinear Techniques, S Parameter, Use of S Parameters with Amplifiers.

Chang, K., et al; "Active Integrated Antennas"; date unknown.

* cited by examiner

METHOD AND APPARATUS FOR ADAPTIVELY CONTROLLING ANTENNA PARAMETERS TO ENHANCE EFFICIENCY AND MAINTAIN ANTENNA SIZE COMPACTNESS

This application claims the benefit of U.S. Provisional Patent Application No. 60/619,231 filed on Oct. 15, 2004.

FIELD OF THE INVENTION

The present invention is related generally to antennas for wireless communications devices and specifically to methods and apparatuses for adaptively controlling antenna parameters to improve performance of the communications device.

BACKGROUND OF THE INVENTION

It is known that antenna performance is dependent upon the size, shape and material composition of the antenna elements, the interaction between elements and the relationship between certain antenna physical parameters (e.g., length for a linear antenna and diameter for a loop antenna) and the wavelength of the signal received or transmitted by the antenna. These physical and electrical characteristics determine several antenna operational parameters, including input impedance, gain, directivity, signal polarization, resonant frequency, bandwidth and radiation pattern.

Generally, an operable antenna should have a minimum physical antenna dimension on the order of a half wavelength (or a multiple thereof of the operating frequency to limit energy dissipated in resistive losses and maximize transmitted or received energy. Due to the effect of a ground plane image, a quarter wavelength antenna (or odd integer multiples thereof) operative above a ground plane exhibits properties similar to a half wavelength antenna. Communications device product designers prefer an efficient antenna that is capable of wide bandwidth and/or multiple frequency band operation, electrically matched to the transmitting and receiving components of the communications system, and operable in multiple modes (e.g., selectable signal polarizations and selectable radiation patterns).

The half-wavelength dipole antenna is commonly used in many applications. The radiation pattern is the familiar donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna disposed above a ground plane is derived from the half-wavelength dipole. The physical antenna length is a quarter-wavelength, but interaction of the electromagnetic energy with the ground plane (creating an image antenna) causes the antenna to exhibit half-wavelength dipole performance. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength of the transmitted or received frequency) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics to the standard 50 ohm transmission line.

The well-known patch antenna provides directional hemispherical coverage with a gain of approximately 4.7 dBi. Although small compared to a quarter or half wavelength antenna, the patch antenna has a relatively narrow bandwidth.

Given the advantageous performance of quarter and half wavelength antennas, conventional antennas are typically constructed so that the antenna length is on the order of a quarter wavelength of the radiating frequency and the antenna is operated over a ground plane, or the antenna length is a half wavelength without employing a ground plane. These dimensions allow the antenna to be easily excited and operated at or near a resonant frequency (where the resonant frequency (f) is determined according to the equation $c=\lambda f$, where c is the speed of light and $\lambda$ is the wavelength of the electromagnetic radiation). Half and quarter wavelength antennas limit energy dissipated in resistive losses and maximize the transmitted energy. But as the operational frequency increases/decreases, the operational wavelength decreases/increases and the antenna element dimensions proportionally decrease/increase. In particular, as the resonant frequency of the received or transmitted signal decreases, the dimensions of the quarter wavelength and half wavelength antenna proportionally increase. The resulting larger antenna, even at a quarter wavelength, may not be suitable for use with certain communications devices, especially portable and personal communications devices intended to be carried by a user. Since these antennas tend to be larger than the communications device, they are typically mounted with a portion of the antenna protruding from the communications device and thus are susceptible to breakage The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). For example, operation in multiple frequency bands may be required for operation of the communications device with multiple communications systems, such as a cellular telephone system and a global positioning system. Operation of the device in multiple countries also requires multiple frequency band operation since communications frequencies are not commonly assigned among countries.

Smaller packaging of state-of-the-art communications devices, such as personal handsets, does not provide sufficient space for the conventional quarter and half wavelength antenna elements. It is generally not considered feasible to utilize a single antenna for each operational frequency or to include multiple matching circuits to provide proper resonant frequency operation from a single antenna. Thus physically smaller antennas operating in the frequency bands of interest and providing the other desired antenna-operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: $gain=(\beta R)^2+2\beta R$, where R is the radius of the sphere containing the antenna and $\beta$ is the propagation factor. Increased gain thus requires a physically larger antenna, while users continue to demand physically smaller antennas. As a further constraint, to simplify the system design and strive for minimum cost, equipment designers and system operators prefer to utilize antennas capable of efficient multi-band and/or wide bandwidth operation, to allow the communications device to access various wireless services operating within different frequency bands or such services operating over wide bandwidths. Finally, gain is limited by the known relationship between the antenna operating frequency and the effective antenna length (expressed in wavelengths). That is, the antenna gain is constant for all quarter wavelength antennas of a specific geometry i.e., at that operating frequency where the effective antenna length is a quarter of a wavelength of the operating frequency.

To overcome the antenna size limitations imposed by handset and personal communications devices, antenna designers have turned to the use of so-called slow wave structures where the structure's physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity (c) is the product of the wavelength and the frequency and takes into account the material permittivity and permeability, i.e., $c/((\mathrm{sqrt}(\in_r)\mathrm{sqrt}(\mu_r))=\lambda f$. Since the frequency does not change during propagation through a slow wave structure, if the wave travels slower (i.e., the phase velocity is lower) than the speed of light, the wavelength within the structure is lower than the free space wavelength. The slow-wave structure de-couples the conventional relationship between physical length, resonant frequency and wavelength.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating a slow wave will be physically smaller than the structure propagating a wave at the speed of light. Such slow wave structures can be used as antenna elements or as antenna radiating structures.

As designers of portable communications devices (e.g., cellular handsets) continue to shrink device size while offering more operating features, the requirements for antenna performance become more stringent. Thus achieving the next level of performance for such communications devices requires smaller antennas with improved performance, especially with respect to radiation efficiency. Currently, designers struggle to obtain adequate multi-band antenna performance for the multi-band features of the devices. But as is known, efficiency and bandwidth are related and a design trade-off is therefore required. Designers can optimize performance in one (or in some cases more than one) operating frequency band, but usually must compromises the efficiency or bandwidth to achieve adequate performance in two or more bands simultaneously. However, most portable communications devices seldom require operation in more than one band at any given time.

In addition, modern portable communications devices must maintain size compactness and high efficiency to provide adequate operating time with a limited battery resource. Antenna compactness and efficiency are therefore crucial to achieving commercially viable wireless devices.

The known Chu-Harrington relationship relates the size and bandwidth of an antenna. Generally, as the size decreases the antenna bandwidth also decreases. But to the contrary, as the capabilities of handset communications devices expand to provide for higher data rates and the reception of bandwidth intensive information (e.g., streaming video), the antenna bandwidth must be increased.

Current wireless communications devices operating according to the various common communications protocols, e.g., GSM, EDGE, CDMA and WCDMA, suffer operating deficiencies as set forth below.

A. Poor power amplifier (PA) efficiency due to impedance matching of the antenna and the power amplifier only for maximum power output, without considering PA output impedance changes as a function of the PA's output power level.

B. Poor PA efficiency due to poor antenna/PA impedance matching over multiple frequency bands or within a band, due primarily to the antenna's relatively narrow bandwidth resulting from, according to the Chu-Harrington limitation, the relatively small antenna volume. Designers obviously prefer to use small space-saving antennas in the communications device.

C. Poor PA efficiency due to poor antenna/PA impedance matching over multiple frequency bands or within band resulting from hand-effect or proximity effect detuning of the antenna resonant frequency.

D. Loss of radiative energy transfer (coupling inefficiency) due to poor antenna/PA impedance matching resulting from antenna bandwidth limitations due to the use of a relatively small antenna in the communications device, which, according to the Chu-Harrington relation, has a relatively narrow bandwidth.

E. Loss of radiative energy transfer (coupling efficiency) due to detuning of the antenna resonant frequency caused by the hand-effect or proximity effect.

Antenna tuning control techniques are known in the art to accommodate multiple band performance of an antenna structure. The present invention teaches methods and apparatuses for antenna control to overcome impedance mismatching and detuning effects that impair performance of the communications device.

BRIEF SUMMARY OF THE INVENTION

According to one embodiment, the present invention comprises an antenna controlled by an antenna controller. The antenna comprises a radiating structure and a plurality of switchable terminal locations disposed on the radiating structure. The controller selects one of the plurality of terminal locations for controlling the antenna impedance.

According to another embodiment, the present invention comprises a method for controlling a communications device comprising a power amplifier and an antenna. The method comprising determining an operating parameter of the power amplifier and controlling an operating parameter of the antenna responsive to a determined operating parameter of the power amplifier.

BRIEF DESCRIPTION OF THE DRAWINGS

The present invention can be more easily understood and the advantages and uses thereof more readily apparent when the following detailed description of the present invention is read in conjunction with the figures wherein.

In accordance with common practice, the various described device features are not drawn to scale, but are drawn to emphasize specific features relevant to the invention. Like reference characters denote like elements throughout the figures and text.

DETAILED DESCRIPTION OF THE INVENTION

Figure 1:
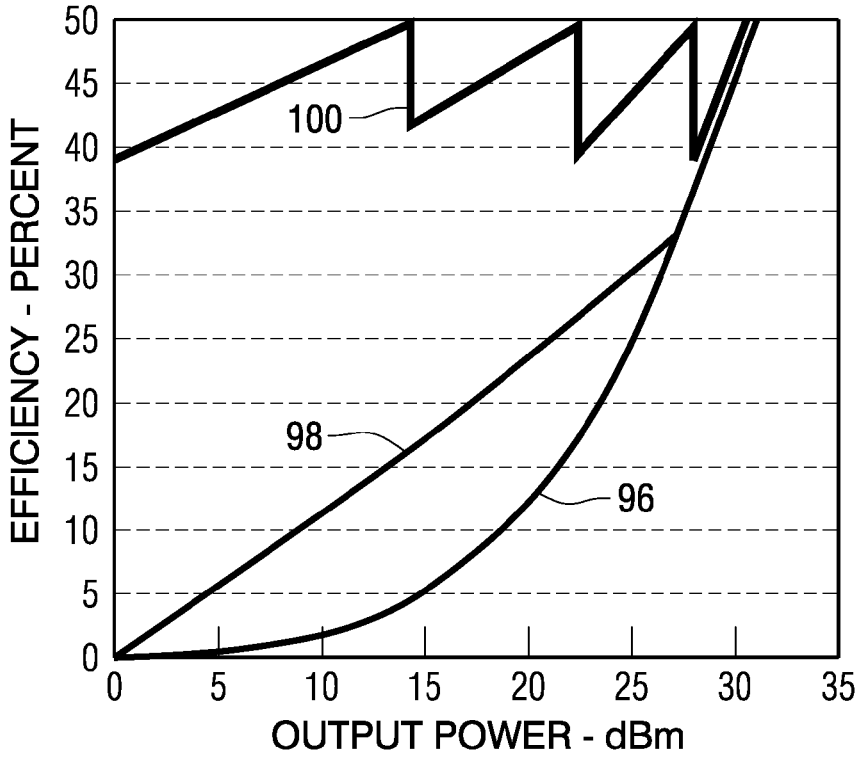
FIG. 1 is a graph illustrating power amplifier efficiency as a function of power amplifier output power

Before describing in detail the particular method and apparatus related to controlling antenna structures and operating parameters, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

According to one embodiment of the present invention, the antenna is retuned (by controlling its effective electrical length) to a desired resonant frequency to obviate resonance detuning caused by the operating environment of the antenna. Tuning the antenna increases the antenna's efficiency and thus optimizes performance of the communications device.

Another embodiment of the present invention controls the antenna impedance to substantially match an output impedance of a power amplifier supplying a transmit signal to the antenna. The power amplifier's output impedance is a function of the amplifier's output power level, where the PA power level is determined by the communications device as required for acceptable operation. Efficient operation of the power amplifier extends battery life and is therefore a desired operational attribute. Antenna impedance tuning affects (improves) the PA efficiency. The antenna impedance is controllable to match the PA output impedance over a range of expected PA output power levels and corresponding PA output impedances.

Conventionally, the power amplifier is designed to provide a range of output power levels and present a specified output impedance (including any impedance transformation elements for matching the PA output impedance to the antenna input impedance) for a specific communications device and communications protocol. The power amplifier is controlled by other components of the communications device to provide a specific output power responsive to the requirements of the communications device for effectively communicating with another communications device, such as a handset communicating with a base station. At a nominal output power and output impedance, the PA operates at a known efficiency. However, as the output power (and/or the antenna impedance) fluctuate during operation, for example when additional handset power is required for communicating with the base station, the PA efficiency declines.

Generally, the PA output impedance is a few ohms (3Ω for a common PA topology), and must be transformed to the input impedance of the antenna, nominally 50Ω. Given this requirement for a relatively large impedance transformation, the reactive network employed to make the transformation has a relatively narrow bandwidth. Thus to maintain an impedance match between the PA and the antenna, it is desired to obviate antenna impedance deviations, as taught by the present invention. It is also recognized that the antenna is a relatively high-Q (i.e., narrow band) device, thus exacerbating the effects of any impedance deviations from its nominal impedance.

There are known attempts to improve the PA efficiency in response to changing operating conditions. One such techniques uses a DC-to-DC converter to supply a controllable DC bias voltage to the PA, where the bias voltage is controlled in response to the demanded PA output power. At certain PA output power levels this technique can increase the PA efficiency.

FIG. 1 illustrates a graph of power amplifier efficiency as a function of power amplifier output power (in dBm). Curve 96 depicts the efficiency when the PA supplies a signal to a fixed-impedance antenna. Curve 98 depicts the efficiency for a PA augmented with a DC-DC converter.

To solve the problem of PA inefficiencies associated with power output level variation, the present invention provides dynamic and adaptive antenna impedance control responsive to the power output level of the PA. In one embodiment as illustrated in FIG. 1, the antenna impedance is adjusted, according to techniques described below, in discrete steps between a first efficiency level of 40% and a second efficiency of about 50%. As depicted by a curve 100, as the efficiency falls to about 40%, the antenna impedance is adjusted to improve the impedance match between the antenna and the PA, raising the efficiency back to about 50%. The present invention therefore provides better power efficiency at moderate power levels, where many cellular phones and other wireless communication devices typically operate. Statistically, GSM handsets operate at about 18 dBm on the average, where the efficiency is typically less than 25% according to prior art impedance matching techniques.

The efficiency values depicted in FIG. 1 are merely exemplary, as it is known that the actual PA efficiency and the theoretical maximum possible efficiency are determined by many factors, including the communications protocol and the power amplifier design. As illustrated in FIG. 1, the PA efficiency is improved at discrete power levels from about 0 to about 30 dBm, although the technique can be applied generally to PA's operating at any power level. Also, the PA efficiency can be improved continuously, rather than discretely as depicted, by continuously modifying the antenna impedance in response to power level changes.

Figure 2:
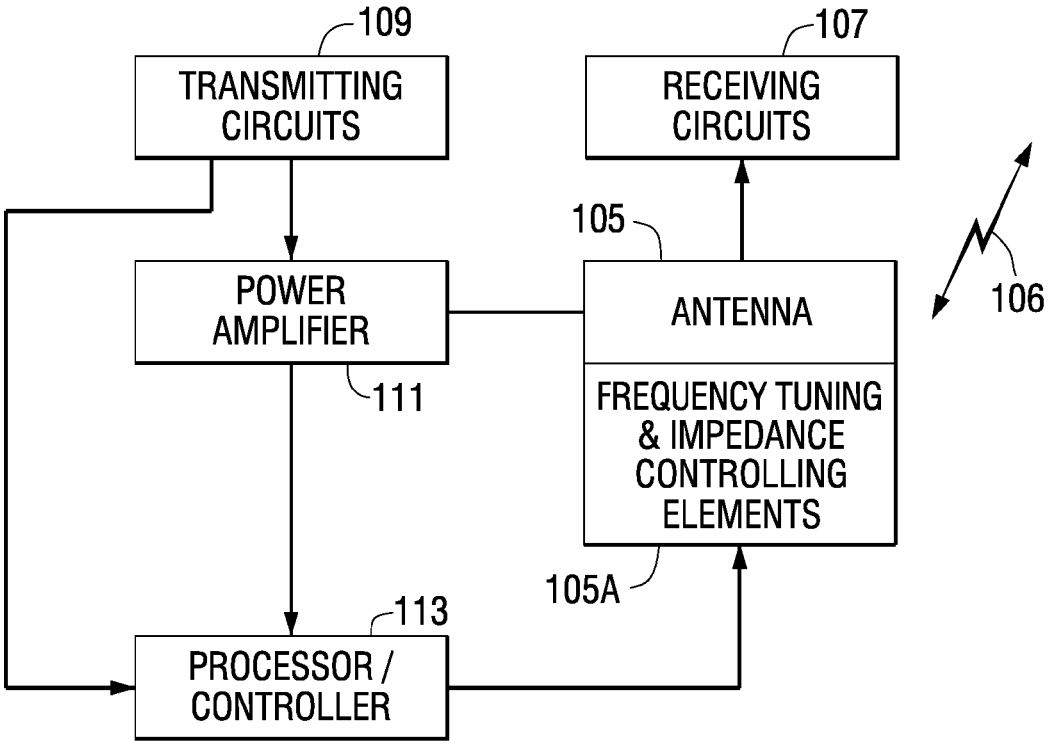
FIG. 2 is a block diagram of a communications device according to the teachings of the present invention.

In one embodiment of the present invention a processor or controller controls one or more antenna elements for frequency tuning the antenna or one or more antenna elements for modifying the antenna's impedance. FIG. 2 illustrates an antenna 105 for receiving and transmitting information signals over a radio frequency link 106. In one embodiment, the antenna is disposed within a cellular telephone handset or other communications device not shown. Signals received by the antenna 105 are processed by receiving circuits 107 to extract information contained therein. Information signals for transmitting by the antenna 105 are produced in the transmitting circuits 109 and supplied to the antenna 105, via a power amplifier 111, for transmitting over the radio frequency link 106.

A processor/controller 113 (e.g., an antenna controller) is responsive to the transmitting circuits 109 and the power amplifier 111 for determining certain operational parameters from which a control signal is developed for controlling resonant frequency tuning and impedance controlling elements 105A of the antenna 105. For example, the processor/controller 113 can select a location for a feed point and/or a ground point on the antenna structure to optimize the antenna's impedance responsive to the power amplifier impedance or can change the effective electrical antenna length by controlling radiating segments to lengthen or shorten the radiating structure.

In an embodiment where the resonant frequency tuning and impedance controlling elements 105A comprise one or more impedance matching circuits (each comprising one or more inductive and capacitive elements), the processor/controller 113 switches in or connects one or more of the impedance matching circuits to the antenna 105 to improve the impedance match between the PA 111 and the antenna 105. In another embodiment, the resonant frequency tuning and impedance controlling elements 105A comprise a plurality of reactive elements, controlled by the processor/controller 113 to affect the antenna impedance.

In yet another embodiment, the processor/controller 113 modifies (e.g., by discretely switching antenna elements and related circuits in to the antenna circuit, discretely switching such elements and circuits out of the antenna circuit or moving an antenna ground point relative to its feed point or a feed point relative to the ground point) one or more antenna physical characteristics (e.g., effective electrical length, feed point location, ground point location) to improve performance of the communications device for the frequency band in which the antenna (handset) is operating. Thus, the processor/controller 113 closes a feedback loop including the resonant frequency tuning and impedance controlling elements 105A for improving antenna performance and overall performance of the communications device.

In one embodiment, the effective antenna length can be modified responsive to the control signal provided by the processor/controller 113 by inserting (switching in) or deleting (switching out) conductive elements of differing lengths from the antenna structure. For example, meanderline elements having different effective electrical lengths can be switched in or out of the antenna 105 to alter the resonant frequency.

The processor/controller 113 responds to various signal parameters and/or operating parameters to effectuate control of the resonant frequency tuning and impedance controlling elements 105A, including the PA output impedance and the PA output power (the output power of the PA signal) from which the output impedance can be determined. The voltage standing wave ratio can also be used to effectuate antenna impedance and resonant frequency control.

In another embodiment, the processor 113 adjusts the antenna resonant frequency in an effort to reduce the signal power without impairing the signal quality at the receive end of the communications RF link 106.

According to another embodiment, the antenna 105 in the handset is manually tunable by the user by operation of a discretely adjustable or a continuously adjustable switching element or control component that controls the frequency tuning and impedance controlling elements 105A (e.g., modifying an antenna physical parameter (resonant length or input impedance) to change the antenna performance and/or the antenna parameters that affect antenna performance. Such an embodiment may also include the processor/controller 113 for automatically adjusting the frequency tuning and impedance controlling elements 105A.

Figure 3:
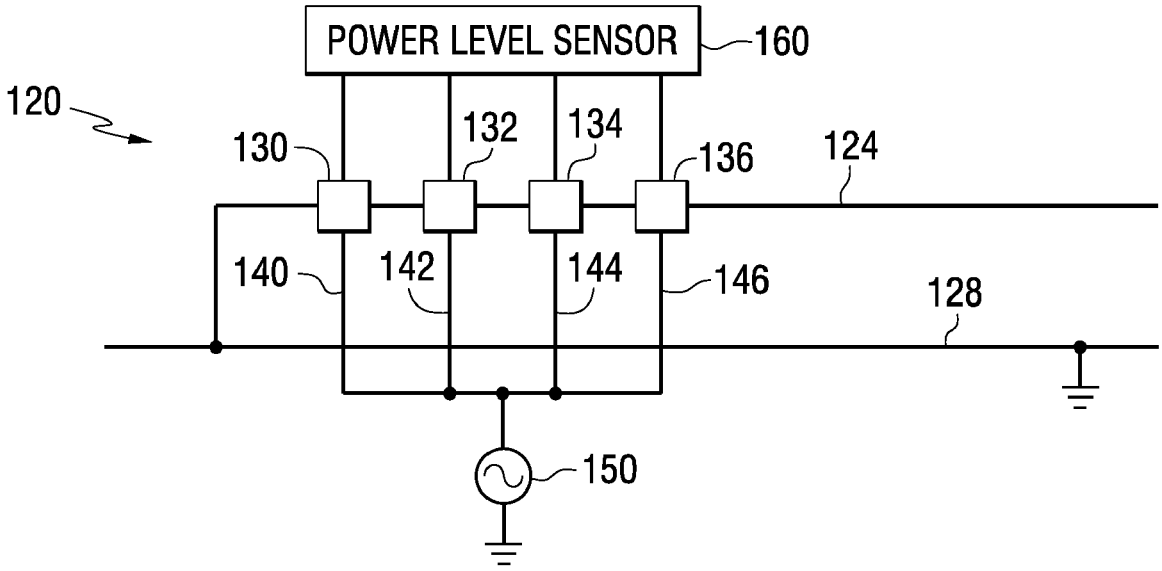
FIGS. 3 and 4 are schematic diagrams of two embodiments of components of a communications device according to the teachings of the present invention.

FIG. 3 illustrates an antenna 120 comprising a conductive element 124 disposed over a ground plane 128. Switching elements 130, 132, 134 and 136 switchably connect feed conductors 140, 142, 144 and 146 to a respective location on the conductive element 124, such that a signal source 150 is connected to the conductive element 124 through the closed switching element 130, 132, 134 or 136. The switching elements 130, 132, 134 and 136 are configured into an opened or a closed state in response to a control signal supplied by a power level sensor 160. Such power level sensors are conventionally associated with commercially available power amplifiers.

Figure 4:
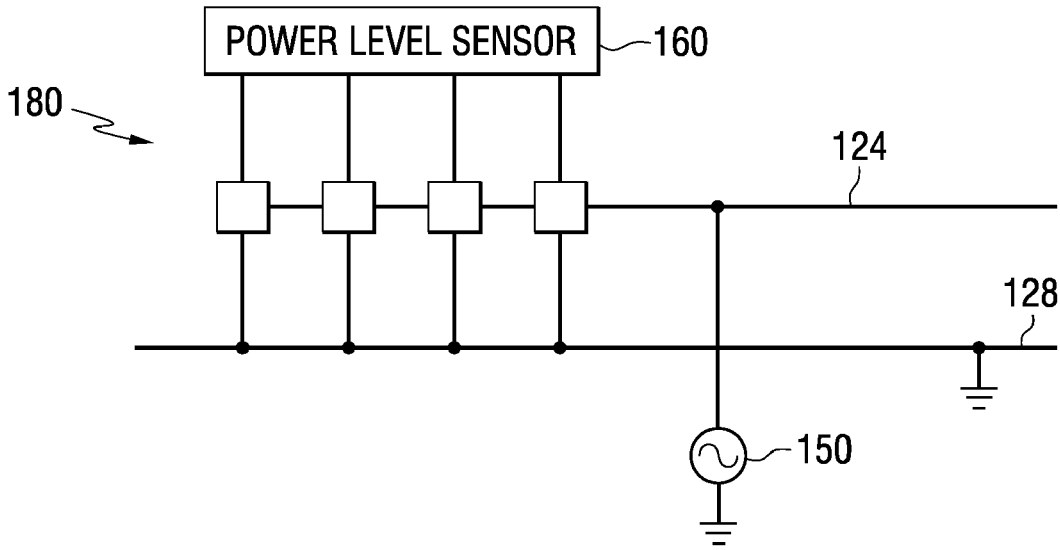

Although the teachings of the present invention are described in conjunction with a PIFA antenna (planar-inverted F antenna) of FIG. 4, the teachings are applicable to other types of antennas, including monopole and dipole antennas, patch antennas, helical antennas and dielectric resonant antennas.

likewise, the antenna's shunt connection to ground may be repositioned by operation of one or more of a plurality of switching elements that each connect the antenna to ground through a different conductive element. FIG. 4 illustrates an antenna 180 comprising switching elements 190, 192, 194 and 196 for switchably connecting conductive elements 200, 202, 204 and 206 to ground. Appropriate ones of the switching elements 200, 202, 204 and 206 are closed or opened at specific power levels (as shown conceptually in FIG. 1, although any number or value may be chosen depending upon the specific application) responsive to control signals supplied by the power level sensor 160.

The switching elements identified in FIGS. 3 and 4 can be implemented by discrete switches (e.g., PIN diodes, control field effect transistors, micro-electro-mechanical systems, or other switching technologies known in the art) to move the feed tap (feed terminal) point or the ground tap (ground terminal) point in the antenna structure, changing the impedance appearing between the feed and ground terminals, i.e., the impedance seen by the power amplifier feeding the antenna. The switching elements can comprise organic laminate carriers attached to the antenna to form a module comprising the antenna and a substrate on which the antenna and its associated components are mounted. Repositioning of the feed point by appropriate selection of one or more of the switching elements can vary the impedance from about five ohms to several hundred ohms for matching the PA impedance.

Figure 5:
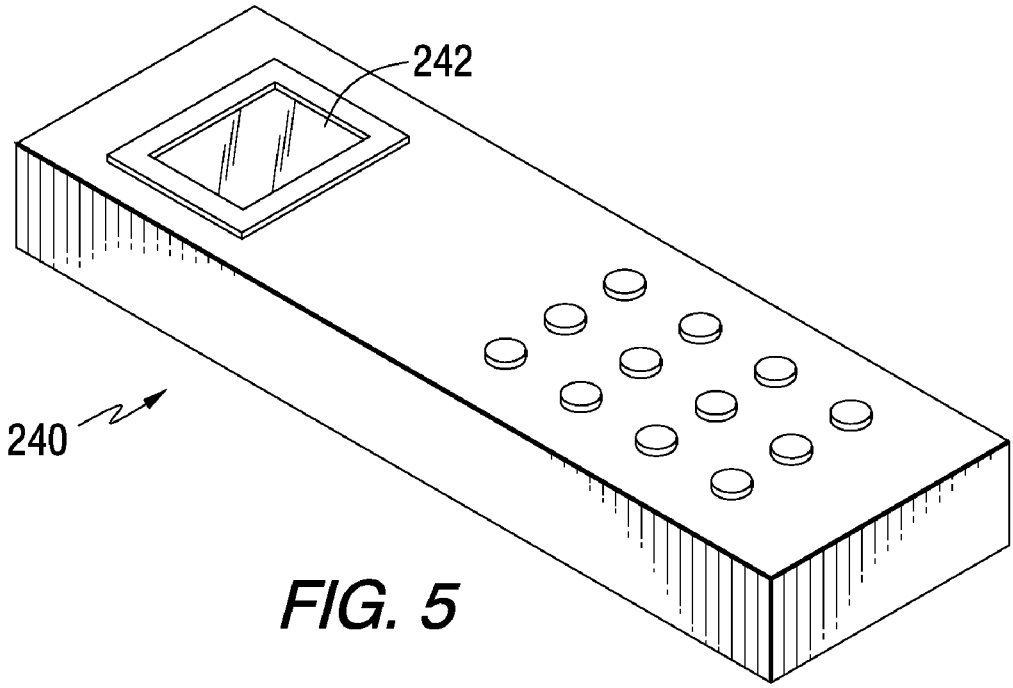
FIG. 5 is a perspective view and FIG. 6 is a cross-sectional view of a handset communications device.

FIG. 5 illustrates a handset or other communications device 240 having an antenna located generally in a region identified by a reference character 242. As is known in the art, when the handset 240 is held by the user for receiving or transmitting a signal, the user's hand is placed proximate the region 242. The distance between the user's hand and the antenna is determined by the user's hand size and orientation of the hand relative to the antenna.

The so-called hand-effect or proximity loading refers to the affect of the user's hand on antenna performance. When the user's hand (and head) are proximate the handset and the antenna disposed therein, the collective dielectric constant of the materials comprising the hand and the head changes the antenna operating characteristics, when compared with operation of the handset and antenna in a free space environment, i.e. wherein air surrounds the antenna and thus antenna performance is determined by the dielectric constant of air.

This effect detunes the antenna resonant frequency, typically lowering the resonant frequency.

For example, a handset designed for operation in the CDMA band of 824-894 MHz includes an antenna that exhibits a resonant frequency peak near the band center and an antenna bandwidth that encompasses most, if not all, of the CDMA frequency band. Thus acceptable performance is achieved for CDMA frequencies. The hand-effect detunes the antenna such that the resonant frequency is moved to a frequency below the band center, or perhaps even out of the band. The result is impaired antenna and handset performance since the antenna bandwidth is no longer coincident with the CDMA frequency band of 824-894 MHz. It is known that the hand-effect can detune the antenna by up to 40-50 MHz for handsets operating in the CDMA band.

One known technique for overcoming the hand-effect uses a wide bandwidth antenna, including the frequencies of interest, i.e. 824-894 MHz, plus frequencies both above and below the band of interest. When the hand-effect detunes the antenna, the operating frequencies of interest may remain within the antenna bandwidth. However, according to the various principles that govern an antenna's physical attributes and performance (e.g., the Chu-Harrington effect), there is a direct relationship between antenna bandwidth and size, i.e., as the antenna bandwidth increases, the antenna size increases. But as handset size continues to shrink, the use of larger antennas to provide wide bandwidth operation is not feasible and is deemed unacceptable by handset designers and users.

Figure 6:
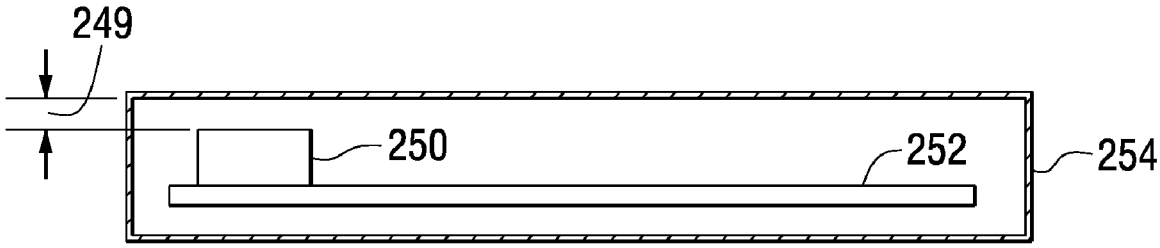

Another known technique for overcoming the hand-effect increases the distance 249 (see FIG. 6) between the antenna 250 (mounted on a printed circuit board 252) and the handset case 254. Increasing this distance by as little as 5 mm appreciably reduces the hand-effect. However, handset size must be increased to accommodate the increased distance.

According to another embodiment of the present invention, a frequency-tunable active internal communications device (handset) antenna overcomes certain of the disadvantages associated with the prior art antennas described above, especially with respect to the hand-effect and proximity antenna loading of the antenna by the body or other objects. Tuning the antenna reduces these effects (in both the transmit and receive modes) and improves the radiated efficiency of the system, i.e., the antenna, power amplifier and related components of the communications device.

Figure 7:
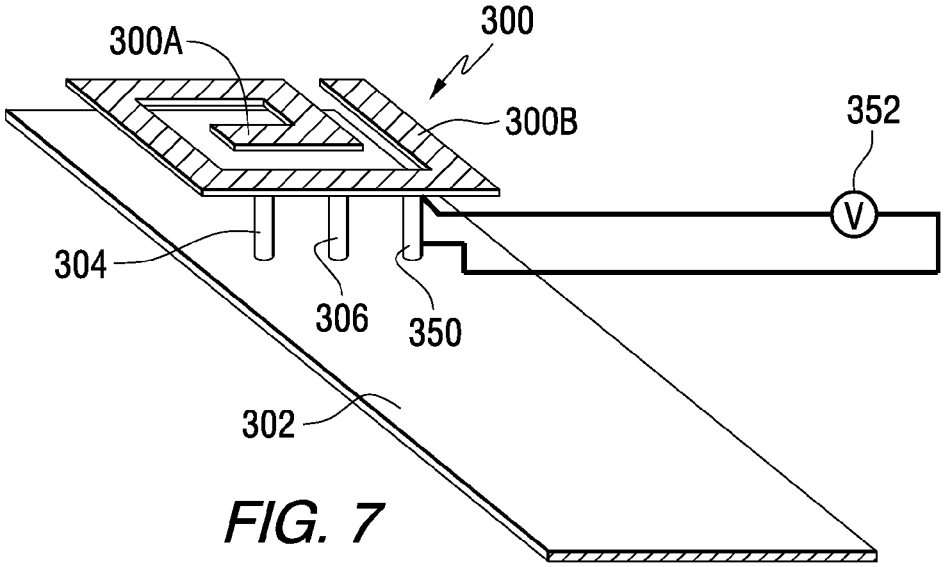
FIG. 7 is a schematic illustration of an antenna according to one embodiment of the present invention.

FIG. 7 illustrates an antenna 300 (in this example the antenna 300 comprises a spiral antenna, but the teachings of the present invention are not limited to spiral antennas) mounted proximate or above a ground plane 302 disposed within a handset communications device. The antenna 300 further comprises an inner spiral segment 300A and an outer spiral segment 300B. A ground terminal 304 of the antenna 300 is connected to the ground plane 302. The handset comprises signal processing components, not shown, operative to process a signal received by the antenna 300 when the handset is operating in the receive mode, and for supplying a signal to the antenna 300 when the handset is operating in the transmit mode. A feed terminal 306 is connected between such additional components and the antenna 300.

Figure 8:
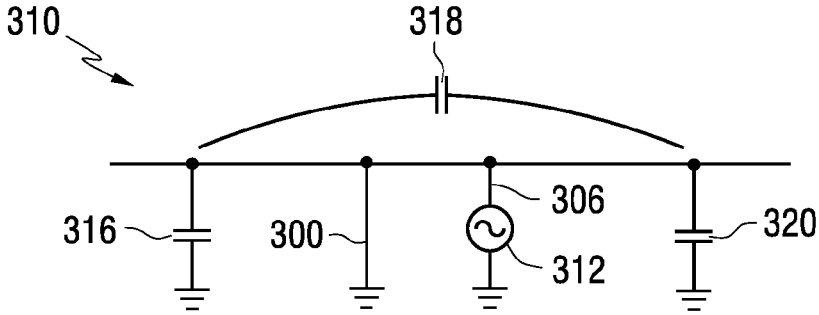
FIG. 8 is a schematic illustration of parasitic capacitances of the antenna of FIG. 7.

An equivalent circuit 310 of the antenna 300 is illustrated in FIG. 8, including a signal source 312 representing the signal to be transmitted by the antenna 300 when the handset is operating in the transmit mode. The equivalent circuit 310 further includes parasitic capacitances 316, 318 and 312 formed from coupling between the inner spiral segment 300A and the ground plane 302, the outer spiral segment 300B and the ground plane 302, and the inner spiral segment 300A with the outer spiral segment 300B, respectively.

According to the teachings of one embodiment of the present invention, one or more of these parasitic capacitances is modified to change the resonant frequency of the antenna 300. Accordingly, as shown in FIG. 7, the antenna 300 further comprises a varactor diode 350 responsive to a voltage source 352 for altering the capacitance of the varactor diode 350 and thus the capacitance between the antenna 300 and the ground plane 302. The antenna resonant frequency is accordingly changed by the capacitance change, which is in turn controlled by the voltage supplied by the voltage source 352. In one embodiment a manually operated controller is provided to permit the handset user to manually adjust the voltage supplied to the varactor diode to tune the antenna 300 for optimum performance.

Generally, changing the capacitance in an area of the antenna 300 where the current is maximum or near maximum causes the most significant change in the resonant frequency. One such area includes a region proximate the ground and/or the feed terminals 304/306, and thus the varactor diode 350 is disposed proximate the ground/feed terminals 304/306. However, it is known that the capacitance can be changed by other techniques that are considered within the scope of the present invention.

According to another embodiment, an inductance of the antenna 300 is modified to change the antenna's resonant frequency. Thus either an inductive or a capacitive reactive component (or both) of the antenna reactance can be modified to change the resonant frequency.

Figure 9:
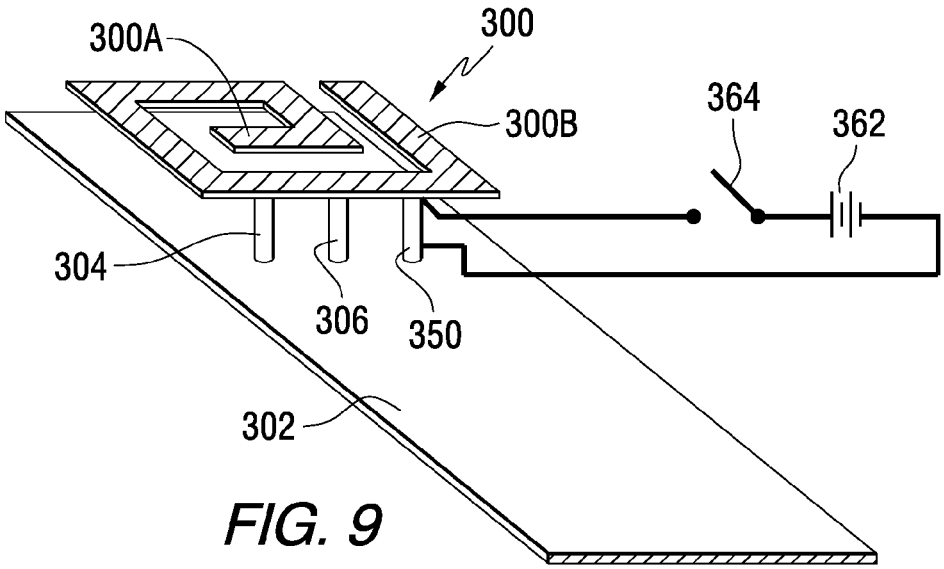
FIG. 9 is a schematic illustration of an antenna according to another embodiment of the present invention.

According to yet another embodiment, the resonant frequency is controlled by application of a discrete DC voltage supplied by a voltage source 362 to the varactor diode 350 via a switching element 364. See FIG. 9.

Thus this embodiment provides a discrete resonant frequency shift in response to the value of the DC voltage when the switching element is placed in a closed or shorted condition. The invention further contemplates multiple voltage sources and corresponding multiple switches to provide multiple capacitance values and thus multiple resonant frequencies from a single antenna. Manual operation of the switching element 364 by the user is provided in one embodiment.

Figure 10:
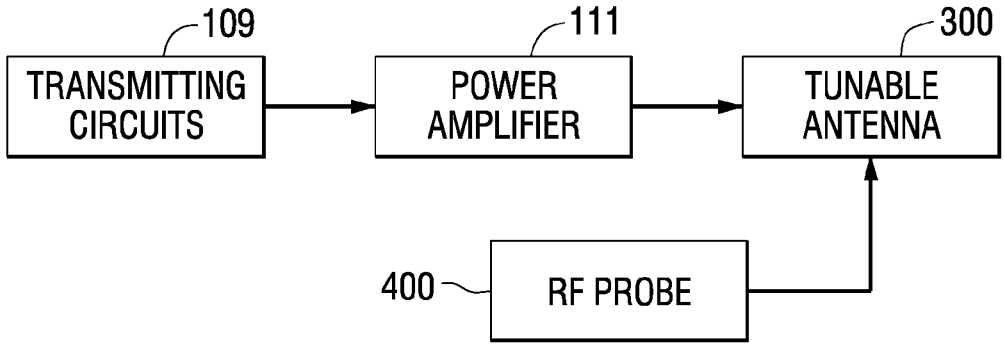
FIGS. 10-15 are block diagram illustrations of additional embodiments of the present invention.

In another embodiment, an RF (radio frequency) probe 400 of FIG. 10 senses the radiated power in the near field region of the antenna 300 responsive to the power amplifier 111. An antenna tuning system, such as those described herein, tunes the antenna frequency to maximize the probe response. Generally, this technique does not compensate for absorption losses in material surrounding the antenna, but corrects for lossless dielectric effects on the antenna frequency.

Certain communications devices or handsets are operable according to multiple cellular telephone protocols (e.g., CDMA, TDMA, GSM), with operation according to each protocol restricted to a different frequency band. In the prior art, such a handset includes multiple antennas, with each antenna designated for operation in one of the frequency bands. The use of multiple antennas obviously increases handset size. The present invention permits the user to change the operating frequency band (by activation of the appropriate switch element to change the antenna resonant frequency) of a single antenna when it is desired to operate the handset according to a different cellular protocol. For handsets that automatically switch to a different available protocol, a handset controller controls the antenna resonant frequency by similarly selecting the appropriate DC voltage for the varactor diode 350, such that the resonant frequency is within the selected operating band.

Figure 11:
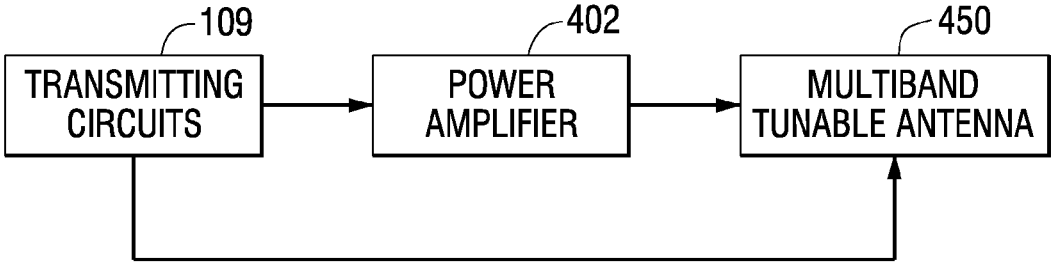

A multiband antenna 450 of FIG. 11 is tuned in response to a signal indicating the current operating subband or band of the communications device, as supplied from the transmitting circuits 109. Since multiband antennas used in current communications devices generally use a single feed and are designed to exhibit multi-resonant behavior, they typically do not and cannot provide an optimal impedance match to the PA or optimal efficiency at all frequencies within the multiple operational bands. If the multiple bands are significantly spaced apart in frequency, optimum performance is even less likely. Application of the teachings of the present invention to multi-band antennas permits optimum performance in all bands by modifying one or more antenna elements in accordance with the instant operational band.

When the communications device switches between operation in a first frequency band to operation in a second frequency band, the impedance presented by the antenna 450 changes and may not match the impedance of the power amplifier 402. For example, the VSWR may increase in the second frequency band. Such a scenario arises in a handset where there is a marked decrease in power amplifier efficiency when switching from operation on the GSM band (880-960 MHz) to operation on the CDMA band (824-894 MHz).

Responsive to a control signal indicating a current operating band or subband the antenna is tuned to optimize antenna resonant frequency and/or impedance matching to the PA, raising PA efficiency and reducing coupling losses due to an impedance mismatches. The tuning can be accomplished by a stub tuner that modifies the antenna impedance to more nearly match the antenna impedance and lower the VSWR. Alternatively, the antenna resonant frequency can be changed by modifying one or more of the antenna's effective electrical length, inductance or capacitance. In one application, antenna band tuning as illustrated in FIG. 11 increased the PA efficiency by about 9%; efficiency increases up to about 20% have also been observed.

Providing an antenna tuning capability permits reduction of the antenna volumetric size (estimated by ½) due to the reduced bandwidth requirement, as the antenna needs to resonate in only one band or sub-band at any time. In one embodiment the antenna impedance and/or the antenna resonant frequency is modified in response to the band control signal. Simulations indicate that in certain applications antenna resonant frequency tuning alone may produce the desired efficiency gain, while maintaining sufficient bandwidth to cover each band or sub-band, thereby taking advantage of the potential for reduced antenna volume.

Figure 12:
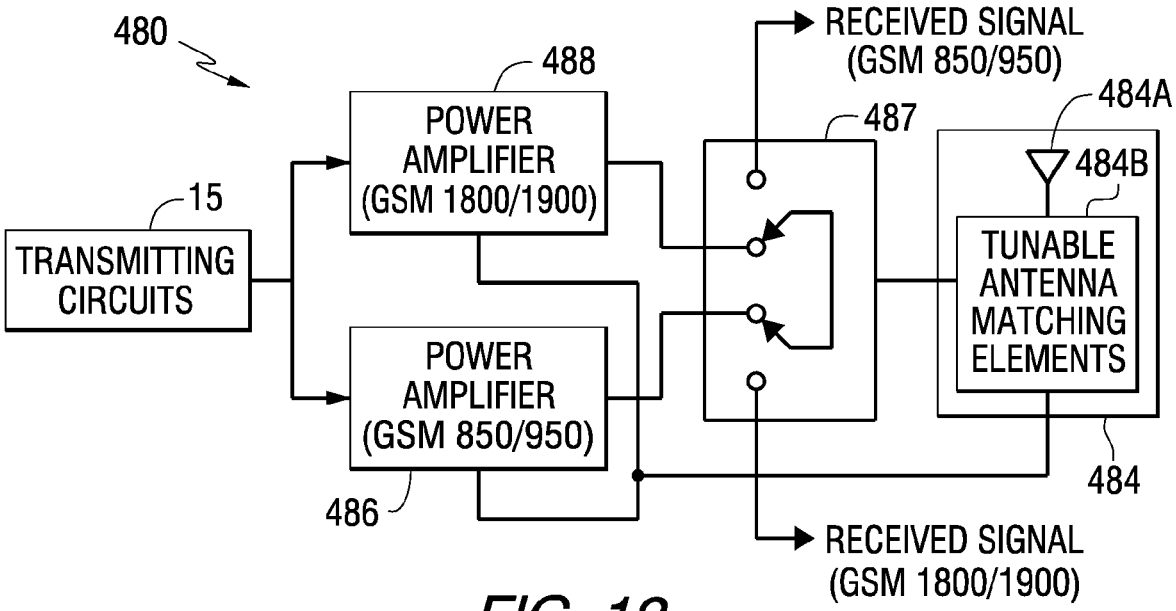

FIG. 12 illustrates certain elements of a dual-band communications device 480 capable of operating in both the GSM band of 850/950 MHz and in the GSM band of 1800/1900 MHz. When operating in the former GSM band, the signal to be transmitted is supplied to an antenna 484 though a power amplifier 486 and a properly configured transmit/receive control switch 487. When operating in the latter GSM band, the signal to be transmitted is supplied to the antenna 484 through a power amplifier 488 and a different configuration of the transmit/receive control switch 487. The antenna 484 comprises a radiating structure 484A and tunable antenna matching elements 484B.

A control signal supplied by the power amplifier 486 and/or 488 to the tunable antenna matching elements 484B indicates the operating band of the communications device 480, controlling the impedance of the elements 484B to substantially match the impedance of the operating power amplifier 486 or 488 and/or controlling a resonant frequency of the antenna 484 to within the operating frequency band.

Although described in conjunction with a communications device operating in one of the GSM bands, the teachings of the present invention are also applicable to other signal transmission protocol, i.e. GSM, EGSM, CDMA, DCS, PCS, etc.

Providing the capability to tune the antenna in a communications device also permits use of smaller antenna structures while the antenna structures operate at a higher efficiency than prior art antennas. Although not apparent, this is a direct result of the Chu-Harrington relationship between bandwidth and antenna volume. Generally, a smaller antenna exhibits a narrower bandwidth, but if antenna operation is limited to a current operating band of the communications device, then a wide band antenna capable of acceptable operation in all frequency bands in which the communications device operates is not required. For example, a smaller more efficient antenna can be employed in the communications device if the antenna's operating band or subband is selectable and the antenna is tunable to the operating bandwidth. Thus in a half duplex communications system, a position of the transmit/receive control switch commands the antenna to change frequency to the operative subband depending on whether the wireless device is in the transmit or receive state. This technique allows most antennas to be reduced in volume by about a factor of ½ and commensurately increases the antenna's efficiency.

According to another embodiment, for half-duplex communication protocols a communications device processor selects either the receive or the transmit portion of the band (sub-band) depending on the handset operational mode and in response alters one or more antenna parameters, by the herein described technique of selecting a feed point or ground point location or switching antenna elements. Since the sub-bands have a narrower bandwidth than the full band, antenna size can be reduced according to this embodiment.

What is not obvious to those trained in the art is that the embodiments of the present invention permit use of a smaller antenna within the communications device, while improving antenna performance (e.g., radiation efficiency) over the operating bandwidth. The ability to alter or select antenna performance parameters (e.g., resonant frequency) in response to the operating frequency obviates the requirement for an antenna that is capable of operating in all possible bands, and further permits use of a smaller adaptive antenna without sacrificing antenna performance. In fact, antenna performance may be improved. At a minimum, constructing a smaller antenna and using the teachings of the present invention to optimize its performance, overcomes the performance limitations of the smaller antenna. Thus smaller handsets can be designed for use with smaller antennas, without sacrificing antenna and handset performance. To optimize antenna performance, the processor can optimize the feed point, ground point, impedance match, antenna configuration or antenna effective length for a given operating condition (e.g., wave polarization) or frequency.

Advantages obtained according to the present invention are: 1) smaller antenna size; and 2) improved antenna efficiency over the bandwidth due to processor adaptive control of the antenna configuration based on the instant operating bandwidth.

Antenna tuning can also overcome the detuning due to hand or other proximity effects. It is well known that antenna frequency can shift when the user brings body parts or other objects in proximity to the handset or wireless communications device. Two physical phenomena occur in that case, both resulting in poorer handset signal reception and transmission. The first effect is detuning of the antenna resonance caused by proximal capacitive loading of the antenna. The second is absorption of signals caused by resistive loss mechanisms (including complex-valued dielectric constants) associated with dielectric properties of the proximate biological or other substances (wood, paper, water, etc.).

Operating wireless handheld devices in proximity to the human body often results in over 7 dB of loss in the far field radiated signal. At least 3 dB of loss is attributable to absorption, as verified by published simulation studies. A portion of the remaining loss may be therefore be attributable to antenna detuning effects (4 db or more).

The present invention actively tunes the antenna, but may not correct for the aforementioned loss due to absorption of the radiated field components. Nevertheless, this approach improves the handset receive or transmit performance by many decibels. Current reduction of radiated signal performance due to hand/head loading is typically from −3 dBi to over −10 dBi. Estimates are that 4 dB or more added gain may result from the near field controlled tuning technique of the present invention.

Figure 13:
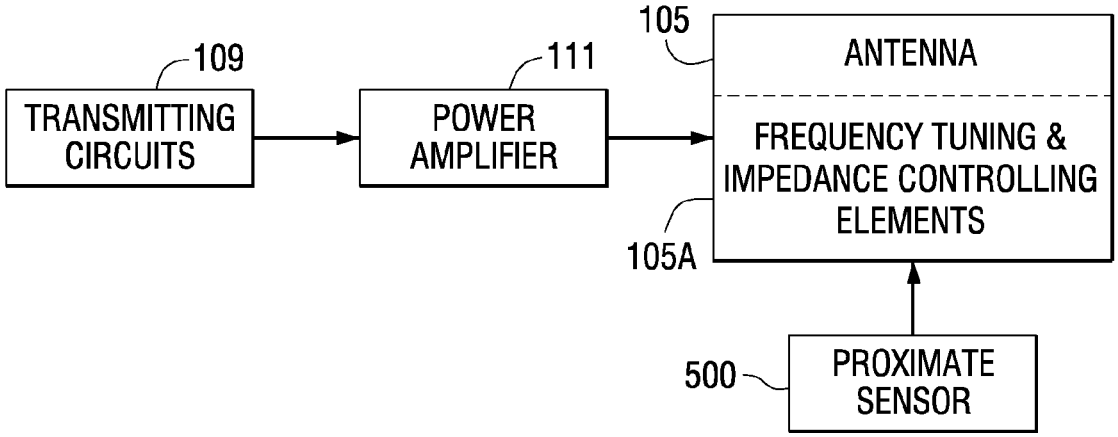

This embodiment can be implemented by altering the inductive or capacitive tuning elements in the antenna, such as by controlling the frequency tuning and impedance controls elements 105A responsive to a proximate sensor 500 as illustrated in FIG. 13. The embodiment can also be implemented by changing the effective electrical length of the antenna as described above.

Figure 14:
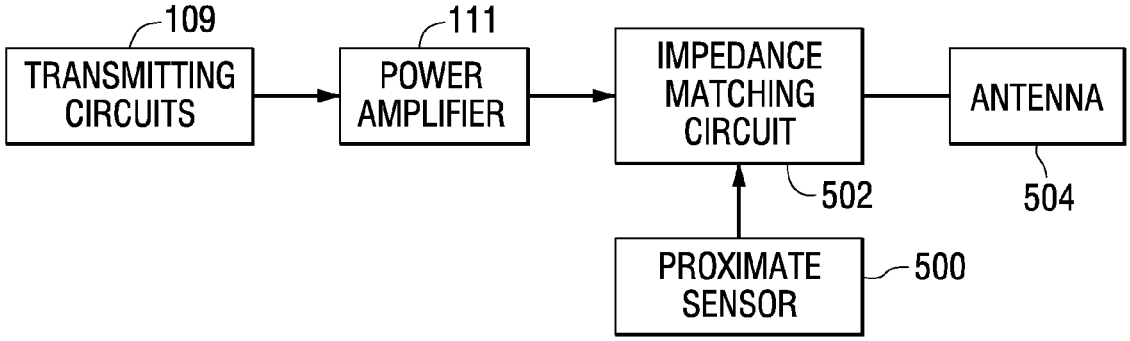

In another embodiment, the proximate sensor 500 supplies a control signal to an antenna impedance matching circuit 502 (see FIG. 14) for controlling the impedance seen by the power amplifier 111 into an antenna 504.

The proximate sensor comprises a sensor that detects the presence of the body or a body part using an optical sensor, a capacitive sensor or another sensing device. In response to that control signal, the antenna is tuned to a predetermined frequency to offset the detuning caused by the proximate object and partially compensating the loss due to the detuning. In another embodiment, the proximate sensor is replaced with a near-field RF probe for supplying a control signal that tunes the antenna to maximize the near field signal.

In another embodiment, antenna resonant frequency tuning is employed during manufacture of the communications device. Since most wireless handsets and wireless devices utilize embedded antennas, the interaction of the near electric and magnetic fields with other components in the device can result in: a) lower radiation efficiency due to excitation of unwanted currents in proximate elements that impose electrically resistive loss mechanisms, or b) dielectric loading effects on elements of the antenna that influence its resonant frequency.

To overcome the dielectric loading effects the present invention comprises a plurality of tuning components (a matrix of components, for example) such as the frequency tuning and impedance matching components 105A or the tunable antenna 300 as described above, that are controlled to account for the expected range of resonant frequency and bandwidth variability encountered in the production of the wireless devices. During the production stage, the tuning components are configured to set the desired resonant frequencies for optimum performance (efficiency, VSWR, etc). In one embodiment, a tuning matrix comprises a passive assembly with fusible links that are opened (blown) to insert matrix components into the antenna circuit. In another embodiment active device switches (control field effect transistors, micro-electro-mechanical systems (MEMS) or other switch technologies known in the art) are utilized to insert components into the antenna circuit by closing one or more of the switching devices.

The teachings of the present invention can also be applied to a communications device providing antenna diversity. That is, each of the diverse antennas includes components to effectuate a change in reactance or a change in effective electrical length to control the antenna resonant frequency.

Figure 15:
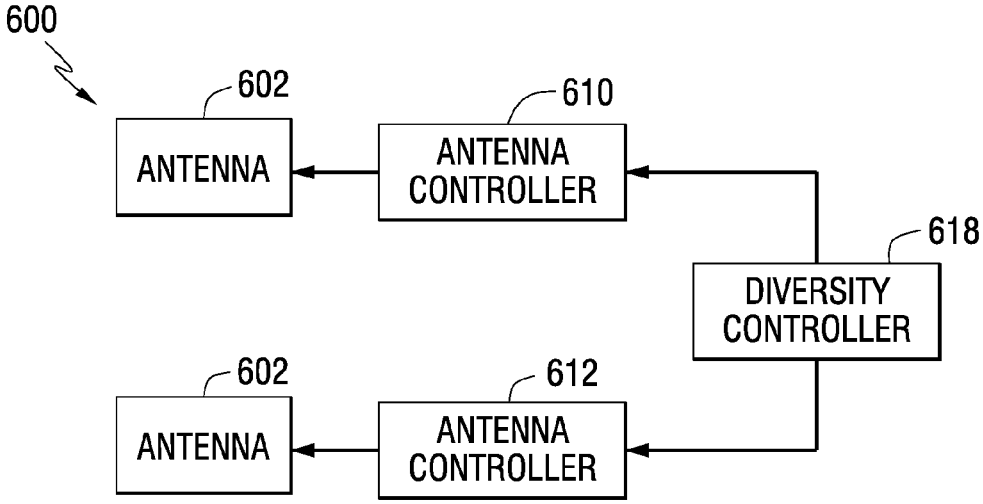

As illustrated in FIG. 15, a communications device 600 includes two antennas 602 and 604, each responsive to an antenna controller 610 and 612 for controlling the respective antenna resonant frequency and/or impedance according to the various teachings and embodiments of the present invention. A diversity controller 618 determines which one of the antennas 610 and 612 is operative at any given time (in the receive mode, the signals can be combined to produce a composite received signal). A processor executing an appropriate algorithm controls the antenna controllers 210 and 212 and the diversity controller 218 to optimize a signal quality metric of the communications device.

While the present invention has been described with reference to preferred embodiments, it will be understood by those skilled in the art that various changes may be made and equivalent elements may be substituted for the elements thereof without departing from the scope of the invention. The scope of the present invention further includes any combination of elements from the various embodiments set forth herein. In addition, modifications may be made to adapt a particular situation to the teachings of the present invention without departing from its essential scope. Therefore, it is intended that the invention not be limited to the particular embodiments disclosed, but that the invention will include all embodiments falling within the scope of the appended claims.

What is claimed is:

1. An antenna operative with a power amplifier, the antenna comprising:

an active element for transmitting signals, supplied by the power amplifier, the power amplifier having an output power responsive to a power control signal, a power amplifier output impedance variable according to the output power;

an antenna impedance controller responsive to the power control signal, or to the power amplifier output power, or to the power amplifier output impedance; and controllable structural elements controllable by the antenna impedance controller, for determining the antenna input impedance and therefore the impedance into which the power amplifier operates to increase the power amplifier efficiency.

2. A wireless communications device comprising:

a power amplifier supplying a signal for transmitting, the power amplifier having a variable output power responsive to a power control signal and a variable output impedance according to the output power;

an antenna having an input impedance, the antenna comprising:

a radiating element antenna for transmitting the signal supplied by the power amplifier;

an antenna impedance controller responsive to the power control signal, to the power amplifier output power, or to the power amplifier output impedance; and controllable structural elements controllable by the antenna impedance controller for determining the antenna input impedance and therefore the impedance into which the power amplifier operates to increase the power amplifier efficiency.

3. The wireless communications device of claim 2 wherein the antenna impedance controller controls the input impedance between a first and a second value by changing characteristics of the controllable structural elements.

4. The wireless communications device of claim 2 wherein the input impedance is continuously controlled to maintain the power amplifier efficiency substantially at a predetermined efficiency.

5. The wireless communications device of claim 2 wherein the controllable structural elements comprise a feed terminal connected to the radiating element, and wherein the antenna impedance controller controls the input impedance of the antenna by modifying a location of the feed terminal on the radiating element.

6. The wireless communications device of claim 2 wherein the controllable structural elements comprise a ground terminal connected between the radiating element and a ground, and wherein the antenna impedance controller controls the input impedance of the antenna by modifying a location of the ground terminal on the radiating element.

7. The wireless communications device of claim 2 wherein the controllable structural elements comprise a feed terminal connected to the radiating element and a ground terminal connected between the radiating element and a ground, and wherein the antenna impedance controller controls the input impedance of the antenna by modifying a distance between the feed terminal and the ground terminal or a location of one or both of the feed terminal and the ground terminal on the radiating element.

8. The wireless communications device of claim 2 further comprising transmitting circuits for producing an information signal supplied to the power amplifier, wherein the power amplifier supplies the signal in response to the information signal, and wherein the transmitting circuits produce a control signal input to the antenna impedance controller for controlling the antenna input impedance.

9. The wireless communications device of claim 2 wherein the power amplifier supplies a control signal to the antenna impedance controller for use by the antenna impedance controller to control the controllable structural elements and thereby the antenna input impedance, wherein the control signal represents an operating parameter of the power amplifier or a characteristic of the signal.

10. The wireless communications device of claim 2 wherein the antenna impedance controller is further responsive to a voltage standing wave ratio of the signal for use by the antenna impedance controller for controlling the input impedance of the antenna.

11. The wireless communications device of claim 2 further comprising a manually operated control element for controlling the impedance into which the power amplifier operates in response to manual manipulation of the control element.

* * * * *